US006877534B1

(12) United States Patent
Hendrickson, Jr. et al.

(10) Patent No.: US 6,877,534 B1
(45) Date of Patent: Apr. 12, 2005

(54) DEBRIS COLLECTION STAND

(76) Inventors: Collins L. Hendrickson, Jr., 1467 Deer Lake Cir., Apopka, FL (US) 32712; Thomas H. Sheffield, 1480 State Rd. #100, Melrose, FL (US) 32666

( * ) Notice: Subject to any disclaimer, the term of this patent is extended or adjusted under 35 U.S.C. 154(b) by 106 days.

(21) Appl. No.: 10/288,430

(22) Filed: Nov. 6, 2002

(51) Int. Cl.[7] ..... B65B 1/00

(52) U.S. Cl. ..... 141/391; 141/231; 141/370; 141/375

(58) Field of Search ..... 141/108, 109, 141/231, 370, 371, 375, 379, 391; 248/97, 136, 168, 170; 414/537

(56) References Cited

U.S. PATENT DOCUMENTS 2,084,711 A * 6/1937 Smith ..... 141/317
2,508,699 A * 5/1950 Welsh ..... 141/108
3,502,291 A 3/1970 Ackerman et al.
3,655,157 A 4/1972 Dalton
3,695,565 A 10/1972 Hodges
3,937,259 A * 2/1976 Sullivan ..... 141/98
4,550,440 A 10/1985 Rico
4,976,406 A 12/1990 Buckley et al.
4,981,274 A 1/1991 McVay et al.
5,040,754 A 8/1991 Dearman
5,048,778 A 9/1991 Wright
5,222,536 A 6/1993 Hodgdon et al.
5,323,990 A 6/1994 Graves
5,403,777 A 4/1995 Bryant et al.

* cited by examiner

*Primary Examiner*—Gregory Huson
*Assistant Examiner*—Peter deVore
(74) *Attorney, Agent, or Firm*—Dowell & Dowell, P.C.

(57) ABSTRACT

A portable and collapsible apparatus for facilitating the collection and disposal of debris, including leaves and other material, which includes a stand for supporting or for straddling a collection receptacle and which stand includes an inclined guide chute by way of which debris may be swept, raked, or otherwise conveyed from a surface upwardly to a point of discharge into the collection receptacle.

16 Claims, 3 Drawing Sheets

DEBRIS COLLECTION STAND

FIELD OF THE INVENTION

This invention is generally directed to devices or implements for facilitating the collection and bagging or containing of debris deposited on lawns and other surfaces and more specifically to a portable and collapsible stand incorporating a chute or ramp for facilitating the raking, sweeping, blowing or otherwise movement of debris from a surface to an open collection receptacle for enclosing debris for disposal or recycling. In a preferred embodiment, the invention has unique utility in the raking or blowing of leaves from lawns and the collection of such leaves in a disposal receptacle.

BRIEF DESCRIPTION OF THE RELATED ART

There have been many implements and devices created to facilitate the manual collection of debris including the collection of lawn and garden debris, such as leaves. The raking and collection of debris, such as leaves is an annual and work intensive task which must be undertaken by property owners in areas where there are deciduous trees.

In some jurisdictions, leaves may be raked or blown into curb areas for collection by large vehicles. However, in many areas, land owners must collect and dispose of leaves by either raking or blowing the leaves into collection receptacles or bags or must otherwise arrange for the hauling of raked or blown leaves to a disposal/recycling facility.

In view of the foregoing, it is often necessary after gathering leaves by raking or blowing, to place the leaves in bags or other receptacles or to lift the leaves into trailers or other vehicles which car transport the debris to appropriate disposal or recycling sites. The effective bagging of debris including leaves is often a frustrating process especially wherein a single individual is both raking the leaves and orienting a collection receptacle to receive the leaves. As debris such as leaves are raked towards a non-supported bag for disposal, the opening of the bag often collapses on itself blocking the entrance for the leaves and other debris thereby requiring manipulation of the bag at the same time that the leaves and other debris is being maneuvered toward the bag. Such a task of raking and bagging simultaneously can become quite frustrating.

In an effort to overcome some of the problems inherent in the manual bagging of leaves and other debris, implements and other collection devices have been designed wherein a receptacle, such as a bag, is oriented along the surface such that the receptacle may be at least partially filled by raking, pushing or blowing the debris horizontally into the receptacle which is maintained open by an appropriate frame. Examples of such devices are disclosed in U.S. Pat. No. 5,222,536 to Hodgdon et al. and U.S. Pat. No. 4,550,440 to Rico.

However, the horizontal filling a receptacle, such as a bag, is not satisfactory. Firstly, the receptacle can not be fully filled when inclined horizontally and therefore must be uprighted for complete filling, thereby requiring the manual lifting of the bag and debris and thereafter the manual lifting of debris into the bag or receptacle. Further, when a receptacle is filled horizontally, it is likely that leaves or other debris will become discharged from the receptacle during a reorientation of the receptacle from a horizontal filling position to a vertical compaction position.

To further facilitate and enhance the bagging of debris, including leaves and other lawn and garden waste, a variety of stands for holding waste receptacles or collection receptacles have been designed such that bags or other receptacles are supported in an upright and open position to facilitate the reception of debris. Many of these stands include a fixed base which may include legs or frames which support an upper member from which a bag or other receptacle may be suspended. Unfortunately, not only are such stands bulky and often hard to move or store, the debris must still be lifted manually to load in bags or receptacles supported by the stands, thus not reducing the amount of physical effort required to fill bags for debris disposal.

To improve on the conventional bag supporting stands, some stands are specifically designed to be portable and collapsible to enhance storage. Such stands are disclosed by way of example in U.S. Pat. No. 3,502,291 to Ackerman et al., U.S. Pat. No. 3,976,406 to Buckley et al., and U.S. Pat. No. 3,655,157 to Dalton. Again, however, the amount of physical effort which must be expended to fill collection bags or receptacles supported by such stands is not significantly reduced over more conventional fixed stands.

A further improvement with respect to the elevational and feeding of debris, such as leaves, to a suspended receptacle is disclosed in U.S. Pat. No. 5,323,990 to Graves. This patent disc loses a leaf ramp which is constructed of a stand-like device having a sloped ramp-like portion including an inclined surface and sidewalls which can be used to guide leaves upwardly toward an opening defined by a frame from which a collection bag or receptacle is suspended. This type of bagging device provides a utility over conventional bag supports in that no lifting of debris is required as the debris is raked along an inclined surface to a bag suspended from the stand, however, the stand is quite bulky and thus difficult to store. In one embodiment, the stand can be made in multiple sections, however, the sections themselves are not conducive for compact storage nor easy of portability.

In view of the foregoing, there remains a need to provide for an implement or device which can be used for the raking, blowing, pushing or otherwise movement and subsequent collection of debris, including lawn and garden debris such as leaves, wherein the implement may be easily transported or moved from site to site and which can be easily collapsed into a compact configuration for storage.

SUMMARY OF THE INVENTION

The present invention is directed to an implement for uses in facilitating the raking, blowing and otherwise collection of leaves and other types of debris wherein the implement includes a stand having an upper frame supported by legs which are pivotable with respect thereto such that entire stand may be folded into a collapsed and compact configuration for storage. In the preferred embodiment, two of the legs which support the upper frame are inclined outwardly and downwardly relative thereto. The sloped legs serve as a support for a guide chute or ramp which is mounted between the inclined legs so as to provide a guide surface for elevating leaves or the debris from a surface upwardly toward the frame. The upper frame is designed to support a bag, or in the alternative, a collection receptacle may be mounted beneath the frame such that leaves or other debris being raked up the chute or ramp enters an opening in the bag supported by the upper frame or enters into an opening into a container mounted below the upper frame.

In the preferred embodiment of the invention, the chute or ramp includes a pair of guide flanges or side members which may be mounted to frame elements which are pivotable relative to each of the inclined legs of the stand such that the flanges may be folded into a collapsed and compact configuration for storage.

In some embodiments, the chute or ramp may be formed of a heavy canvas material which may be reinforced in its central section by a metal or plastic mesh type material. The upper portion of the chute or ramp may include a flexible extension which is foldable over one edge of the upper frame such that the upper edge can be inserted within an opening in a bag supported by the frame or inserted into the opening of a container mounted beneath the stand. The lower end of the chute or ramp may further include an extension designed to form a flexible tapered edge which extends outwardly from the base of the ramp to facilitate the movement of leaves and other debris onto the surface of the ramp as the debris is raked, blown or otherwise moved toward the chute or ramp.

In some embodiments, the chute or ramp may be formed of plastic or other types of material, however, in the embodiment wherein a flexible canvas type of material is used, the material may be selectively mounted to the incline legs as well as to the pivotal frame elements by the use of hook-and-loop type Velco™ type fastening materials such that the canvas material may be easily removed from the frames for replacement, repair or cleaning.

It is the primary object of this invention to provide an implement to facilitate the collection of leaves and other types of debris from lawns and other surfaces wherein the implement provides an inclined ramp or chute along which the debris may be racked, blown or otherwise moved upwardly to an opening in a bag either suspended from the implement or into a container mounted beneath the implement thereby facilitating the bagging or collection of the debris without requiring an individual to lift the debris into a collection receptacle.

It is yet a further object of the present invention to provide an implement for facilitating the collection of leaves and other types of debris wherein the implement provides a ramp or chute for guiding material into a collection receptacle wherein the entire implement frame may be folded upon itself in order to permit the compact storage of the implement when not in use.

It is yet a further object of the present invention to provide a stand which provides a ramp-like surface for the movement of leaves and other debris toward a collection receptacle wherein the entire implement is lightweight and portable.

BRIEF DESCRIPTION OF THE DRAWINGS

A better understanding of the invention will be had with respect to the accompanying drawings wherein.

DESCRIPTION OF THE PREFERRED EMBODIMENT

Figure 1:
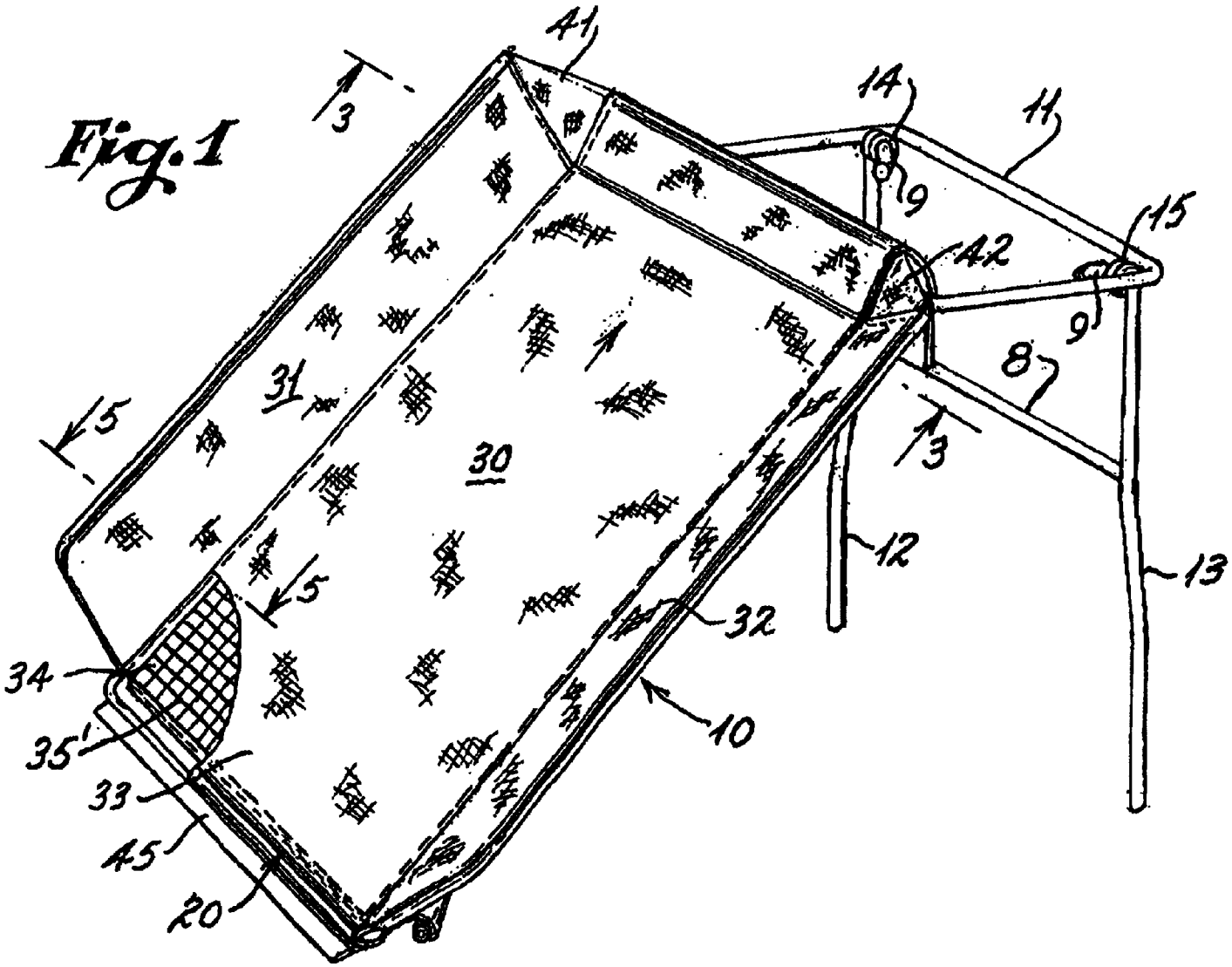
FIG. 1 is a perspective illustrational view having portions broken away of a preferred embodiment of the implement of the present invention showing the ramp or chute associated therewith in a fully deployed position.

With continued reference to the drawing figures the implement for facilitating the collection of leaves and other debris includes a stand 10. The stand includes an upper open frame 11 which is shown in the drawing figures as being generally rectangular or square in configuration and formed of a metal rod. The configuration may vary such that the frame may be circular, oval or other configuration and may be formed of other materials such as heavy plastic. The frame is supported by a first pair of legs 12 and 13 which are pivotably mounted at 14 and 15, respectively to corners of the support frame 11 such that the legs may be folded into generally parallel relationship with the frame to facilitate the compact storage of the stand. The legs may be reinforced by a horizontal cross-bar such as shown at 8 in the drawing figures. A pair of abutment members or stops 9 are welded or otherwise secured to the frame 11 adjacent the pivot 14 and 15 and serve to limit the degree of rotation of the legs 12 and 13 relative to the frame.

The frame is also supported by a pair of outwardly extending inclined legs 16 and 17 which are pivotably mounted at 18 and 19, respectively to the frame 11 such that the inclined legs may also be pivoted into generally parallel relationship with respect to the support frame 11 when the stand is not in use to thereby facilitate compact storage as will be described in greater detail hereinafter.

In the embodiment shown, the legs 16 and 17 are reinforced by a cross brace 7 which is connected at the lower ends of each of the inclined.

The frame 11, as previously described, is preferably formed of rod-like material which may be a wrought iron. Similarly, the legs 12 and 13 and the inclined legs 16 and 17 may also be formed of a similar material, however, in some instances may be formed of heavy grade plastic.

The inclined legs 16 and 17 are designed to support a chute or ramp member 20 which may be fixedly secured to the legs or removably mounted thereto. To facilitate the guiding of any leaves or other debris which is to be moved upwardly along the ramp or chute 20, the present invention incorporates generally unshaped side frame members 21 and 22. The frame member 21 is pivotally mounted at its ends at 23 about the inclined leg 16 whereas the frame 22 is pivotally mounted at its ends at 24 about the ends of the inclined leg 17. The mountings 23 and 24 may be generally cylindrical bearing type members which surround the legs 16 and 17. Because of the pivotal relationship of the frames 21 and 22 to the inclined legs, the frames may be pivoted relative to the legs so that they extend upwardly and outwardly relative thereto, generally as shown in drawing FIGS. 1 and 6, when the stand is erect. To limit the outward pivotable movement of each of the frames 21 and 22 relative to the legs 16 and 17, stop members 26 and 27 are welded or otherwise secured to extend outwardly from the lower portion of each of the legs 16 and 17 as shown in drawing FIG. 6. As the frames 21 and 22 pivot outwardly they abut the stop members and are retained in an outwardly oriented position as shown in the drawing figures thereby forming walls for the trough, chute or ramp 20.

Figure 6:
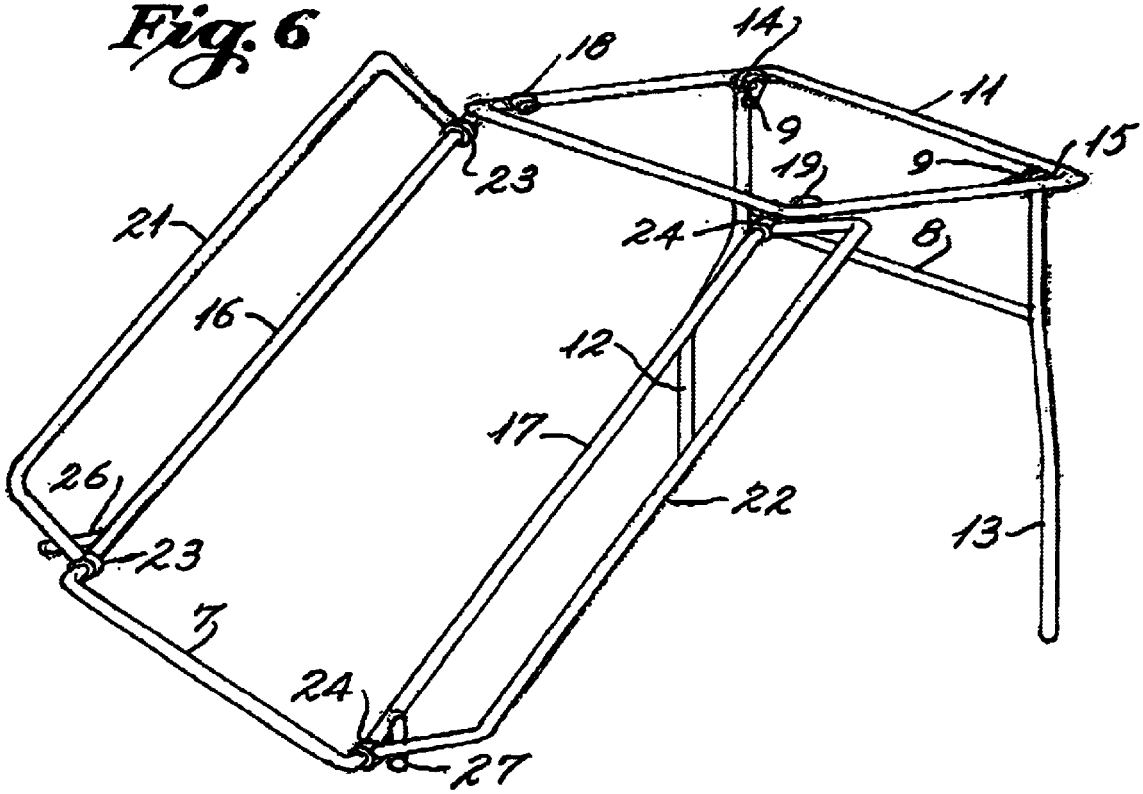
FIG. 6 is a perspective view of the entire frame of the implement of the present invention as shown in FIG. 1.
Figure 7:
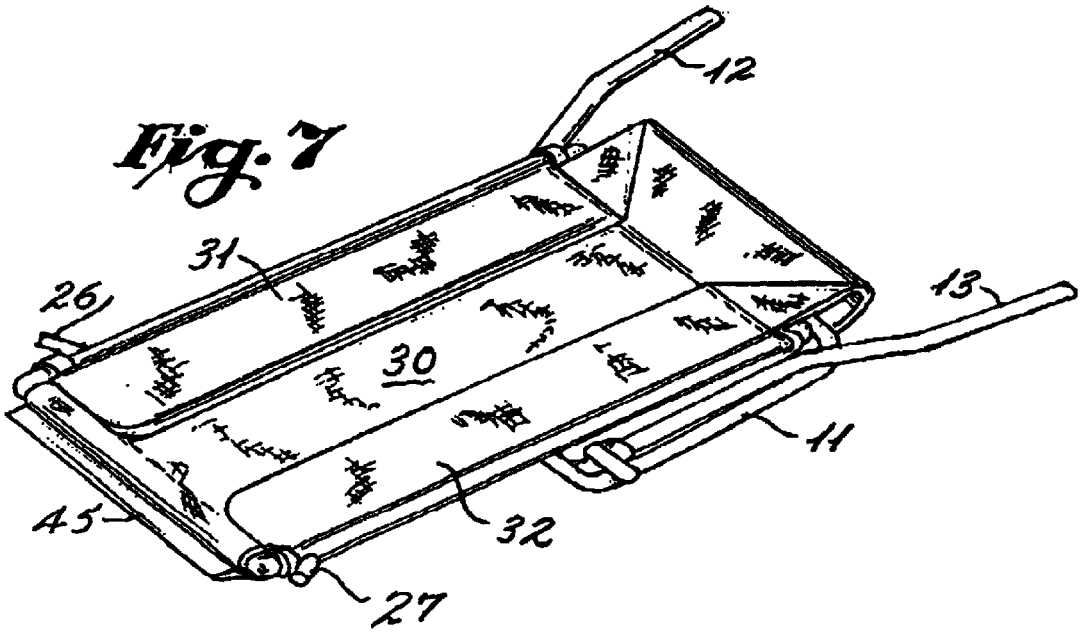
FIG. 7 is a view of the implement in a fully folded and collapsed position suitable for compact storage.

One of the benefits of the present invention is that the stand may be readily assembled for use as shown in FIGS. 1 and 6 but may also be easily folded for compact storage as shown in FIG. 7. In this respect, by folding the legs 12 and 13 relative to the frame 11 and also folding the inclined legs 16 and 17 relative to the frame, the legs and the frame fold into a very compact configuration as is shown in FIG. 7. In this manner, minimum space is taken by the stand when placed into storage. The compact relationship of the elements of the stand when not in use also allows the stand to be easily transported.

Although the ramp or chute 20 may be formed of a rigid material, such as metal or plastic, which is fixedly secured to the legs 16 and 17 and pivot frames 21 and 22, in the preferred embodiment, in order to facilitate the collapsibility and portability of the implement, the chute or ramp is preferably formed of a heavy duty canvas type material. The canvas structure includes a central portion 30 which forms the primary surface of the ramp or chute as shown in FIG. 1 and pair of outer open sleeves 31 and 32 which are adapted to be mounted over the unshaped pivot frames 21 and 22. The sleeves are open along their lower edge such that the sleeve 31 and 32 have layers disposed on opposite sides of the frames.

The central portion 30 is preferably formed of upper lower layers 33 and 34 which are reinforced centrally by a wire screen, mesh or grid 35'. Each of the upper and lower layers 33 and 34 have outer seam portions 35 and 36 on which are adhesively or otherwise secured strips of hook-and-loop Velcro™ type fastening materials 37 and 38. The fastening materials 37 and 38 are engaged after the seam edges 35 and 36 are wrapped about the inclined legs 16 and 17 to thereby secure the canvas material to the legs 16 and 17 and the pivot frames 21 and 22.

As opposed to using removable fasteners such a hoop-and-loop material various other fasteners including snap fasteners, zippers and the like can be used to removably mount the canvas material to the pivot frames 21 and 22 and the legs 16 and 17. In addition, as opposed to removably mounting the canvas material to the frame components, such material may be secured to or sewn directly to the frame components so as to be permanently attached thereto. Because of the flexibility of the canvas material, the pivot frames 21 and 22 will be allowed to fold into the collapsed stored position shown in FIG. 7.

Figure 2:
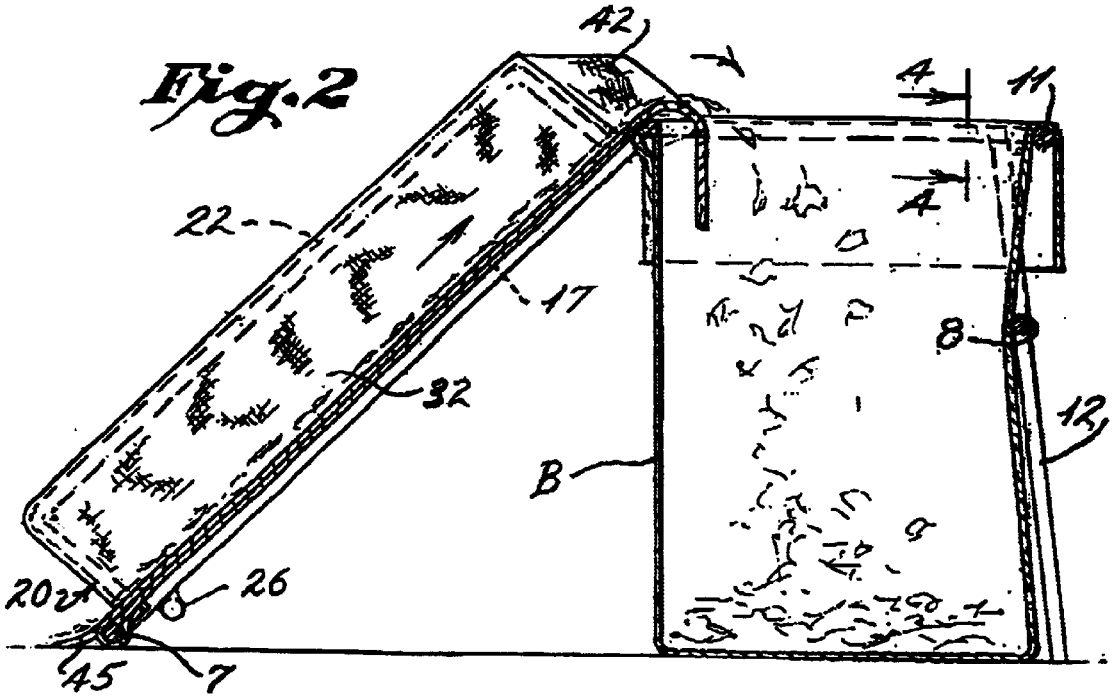
FIG. 2 is a side illustrational view of the implement of FIG. 1 showing a bag suspended from the upper frame of the implement stand.
Figure 3:
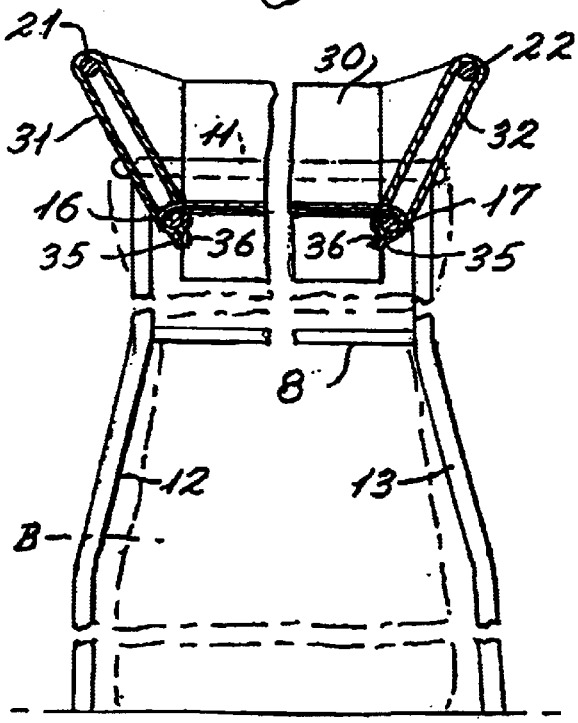
FIG. 3 is a partial cross-sectional view having portions broken away taken along lines 3—3 of FIG. 1.
Figure 4:
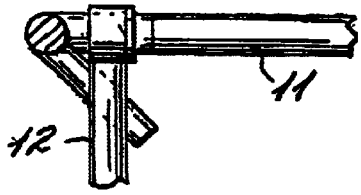
FIG. 4 is a segmented partial cross-sectional view taken along line 4—4 of FIG. 2.
Figure 5:
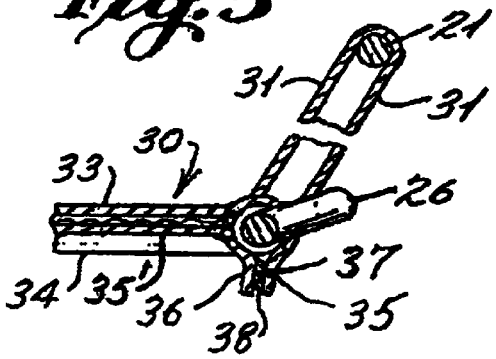
FIG. 5 is a segmented partial cross-sectional view taken along line 5—5 of FIG. 1.

The main body 30 of the canvas material further includes an upper extended portion 40 which is designed to extend over an edge of the upper support frame 11 and into a container, such as a collection bag "B", which is secured to the support frame 11, as is shown in FIG. 2, to thereby provide an element for ensuring that the bag remains open during the collection of debris.

To provide for additional guidance along the sides of the ramp or chute 20, a pair of flaps 41 and 42 extend from the upper edge of each of the sleeves 31 and 32 such that the flaps may be tucked beneath the upper portion 40 of the chute thereby providing a continuous sidewall structure to contain leaves and other debris being moved up the ramp or chute 20 toward the collection receptacle or bag "B". The movement of debris into the bag is shown by the arrows in drawing FIG. 2.

In the use of implement of the present invention, the stand may be easily erected to the configuration shown in FIG. 1 by simply pivoting the legs 12 and 13 relative to the support frame 11 while simultaneously pivoting the inclined legs 16 and 17 outwardly to provide forward support for the frame 11. The canvas material defining the chute or ramp 20 allows for the side frames 21 and 22 to be pivoted outwardly to form lateral barriers for the ramp or chute, as is shown in FIG. 1 to contain leaves and other debris being conveyed upwardly along the surface thereof to a collection receptacle, such as the bag "B". To further facilitate the manner in which leaves or debris are collected, the lower portion of the body 30 of the chute or ramp may include a forward flange or lip 45 which extends outwardly relative to the surface along which debris is being moved toward the angled chute or ramp.

As a bag "B" is filled with leaves or other debris, the extended end portion 40 of the ramp or chute may be elevated away from the opening in the bag and the bag simply lifted from the support frame 11 with another bag being placed on the support frame. As opposed to using bags supported by the frame 11, containers may be placed beneath the frame in order to receive and collect debris, such as leaves, being conveyed along the ramp or chute 20.

For storage, the pivot frames 21 and 22 are folded over the central body 30 of the ramp or chute 20 as is shown in FIG. 7, and thereafter, the legs 12 and 13 and 16 and 17 folded into the collapsed overlaying configuration shown in FIG. 7.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

We claim:

1. An apparatus for collecting debris including a stand having a plurality of support legs pivotally mounted to an upper support frame, a chute having an upper end portion and a lower free end, said upper end portion of said chute being pivotally mounted relative to said upper support frame such that said chute extends outwardly and downwardly relative to said upper support frame to said lower free end when in use, said plurality of support legs and said chute being pivoted to a collapsed storage position in generally parallel relationship with said upper support frame, whereby debris urged upwardly along said chute from said lower free end to said upper end portion will pass by gravity through said upper support frame into a collection receptacle.

2. The apparatus of claim 1 in which a pair of said plurality of support legs are inclined outwardly from first pivot connections said support frame to lower ends, and said chute being secured to said inclined legs whereby said chute is pivotably mounted relative to said upper support frame.

3. The apparatus of claim 2 including stop means for limiting the pivotal movement of at least two of said plurality of support legs relative to said upper support frame.

4. The apparatus of claim 2 wherein said chute includes a pair of spaced upwardly extending side members extending along a substantial length of said chute for purposes of preventing debris from falling from opposite sides of said chute as debris is moved toward said upper support frame.

5. The apparatus of claim 4 including means for hingely mounting said side members relative to a bottom of said chute, and means for maintaining said side members in a raised position extending generally transversely with respect to a primary plane defined by said bottom of said chute.

6. The apparatus of claim 5 wherein said chute includes a flexible material mounted to said pair of included support legs and said side members, and means for releasably securing said flexible material to said pair of inclined support legs.

7. An apparatus for collecting debris including a stand having a plurality of support legs pivotally mounted to an upper support frame, a chute having an upper end portion and a lower free end, said upper end portion being mounted to said upper support frame such that said chute extends outwardly and downwardly relative to said upper support frame to said lower free end, such that debris may be urged upwardly along said chute from said lower free end to said upper end portion and will pass by gravity through said upper support frame into a collection receptacle, a pair of said plurality of support legs being inclined outwardly from first pivot connections at said upper support frame to lower ends, and said chute being mounted to said inclined legs whereby said chute is pivotally mounted relative to said upper support frame.

8. The apparatus of claim 7 including stop means for limiting the pivotal movement of at least two of said plurality of support legs relative to said upper support frame.

9. The apparatus of claim 7 wherein said plurality of support legs and said chute are movable relative to said upper support frame such that said chute and said support legs are generally parallel with respect to one another in a collapsed configuration.

10. The apparatus of claim 9 wherein said chute includes a pair of spaced upwardly extending side members extending along a substantial length of said chute for purposes of preventing debris from falling from opposite sides of said chute as debris is moved toward said upper support frame.

11. The apparatus of claim 10 including means for hingely mounting said side members relative to a bottom of said chute, and means for maintaining said side members in a raised position extending generally transversely with respect to a primary plane defined by said bottom of said chute.

12. The apparatus of claim 11 wherein said chute includes a flexible material mounted to said pair of inclined support legs and said side members, and means for releasably securing said flexible material to said pair of inclined support legs.

13. An apparatus for collecting debris including a stand having a plurality of support legs pivotally mounted to an upper support frame, a chute mounted to a pair of said plurality of support legs, a pair of said plurality of support legs being inclined outwardly and downwardly from said upper support frame such that said chute extends outwardly and downwardly relative to said upper support frame, said chute including a pair of side members pivotally mounted relative to said pair of said plurality of support legs so as to be movable from a first position overlaying said pair of said plurality of support legs to a second position extending transversely with respect to said pair of said plurality of support legs.

14. The apparatus of claim 13 wherein said plurality of support legs and said pair of side members, are movable relative to said upper support frame such that said chute and said support legs are generally parallel with respect to one another in a collapsed configuration.

15. The apparatus of claim 14 in which said chute is formed of a flexible material which is removably mounted to said pair of said plurality of support legs.

16. The apparatus of claim 15 including means for reinforcing at least a portion of said flexible material.

* * * * *